US009702050B2

(12) United States Patent
Yang et al.

(10) Patent No.: US 9,702,050 B2
(45) Date of Patent: Jul. 11, 2017

(54) APPARATUS AND METHOD FOR PRODUCING A GRAPHENE MATERIAL

(71) Applicant: NATIONAL TAIWAN NORMAL UNIVERSITY, Taipei (TW)

(72) Inventors: Chii-Rong Yang, Taipei (TW); Shu-Fang Chang, New Taipei (TW); Tun-Ping Teng, New Taipei (TW); Yu-Ting Chen, Taoyuan (TW); Zi-Ying Chen, New Taipei (TW); Sheng-Chang Chang, Taipei (TW); Meng-Hung Huang, Kaohsiung (TW)

(73) Assignee: NATIONAL TAIWAN NORMAL UNIVERSITY, Taipei (TW)

( * ) Notice: Subject to any disclaimer, the term of this patent is extended or adjusted under 35 U.S.C. 154(b) by 17 days.

(21) Appl. No.: 14/976,267

(22) Filed: Dec. 21, 2015

(65) Prior Publication Data

US 2016/0186341 A1 Jun. 30, 2016

(30) Foreign Application Priority Data

Dec. 25, 2014 (TW) ..... 103145496 A

(51) Int. Cl.
*C25B 15/02* (2006.01)
*C25B 1/00* (2006.01)
*C25B 9/06* (2006.01)

(52) U.S. Cl.
CPC ..... *C25B 15/02* (2013.01); *C25B 1/00* (2013.01); *C25B 9/06* (2013.01)

(58) Field of Classification Search
CPC ..... C25B 15/02; C25B 1/00; C25B 9/06
See application file for complete search history.

(56) References Cited

U.S. PATENT DOCUMENTS

2010/0213052 A1 8/2010 McAlister
2014/0202874 A1* 7/2014 Elgammal ..... C25B 15/08 205/555

FOREIGN PATENT DOCUMENTS

CN 102395710 A 3/2012
CN 102963886 A 3/2013

* cited by examiner

*Primary Examiner* — Arun S Phasge
(74) *Attorney, Agent, or Firm* — Birch, Stewart, Kolasch & Birch, LLP

(57) ABSTRACT

An apparatus for producing a graphene material includes a tank, a container, an agitating module, a second electrode disposed in the tank, and a power supply module. The container is used for receiving a graphite material, and is formed with a plurality of through holes for the electrolyte solution to pass therethrough. The agitating module includes a control unit and an agitating unit used as a first electrode, and inserted into the container for agitating the electrolyte solution and the graphite material. The power supply module is electrically connected to the agitating unit and the second electrode for supplying electric power to generate an electrical potential difference.

13 Claims, 2 Drawing Sheets

APPARATUS AND METHOD FOR PRODUCING A GRAPHENE MATERIAL

CROSS-REFERENCE TO RELATED APPLICATION

This application claims priority of Taiwanese Application No. 103145496, filed on Dec. 25, 2014.

FIELD

The disclosure relates to an apparatus for producing a graphene material and a method for producing a graphene material using the apparatus.

BACKGROUND

Graphene is a single planar sheet of sp2 bonded carbon atoms, and has properties of great electrical conductivity, great thermal conductivity, high transparence, and high mechanical strength in an x-y plane.

Generally, graphene may be formed by solid phase techniques or liquid phase techniques. The liquid phase techniques include chemical exfoliation and electrochemical exfoliation.

Electrochemical exfoliation is carried out by steps of: disposing a graphite material in an electrolyte; applying an electric field to the electrolyte such that ions intercalate into layers of the graphite material to exfoliate the graphite material.

However, reaction yield of electrochemical exfoliation is only around 5% to 8%, leaving ample room for improvement in the art.

SUMMARY

Therefore, an object of the disclosure is to provide an apparatus and a method for producing a graphene material that can alleviate at least one of the drawbacks of the prior art.

According to a first aspect of the disclosure, the apparatus includes a tank, a container, an agitating module, a second electrode, and a power supply module.

The tank is used for receiving an electrolyte solution.

The container is placed in the tank, is used for receiving a graphite material, and is formed with a plurality of through holes for the electrolyte solution to pass therethrough.

The agitating module includes a control unit and an agitating unit controlled by the control unit. The agitating unit is electrically conductive to be used as a first electrode and is inserted into the container for agitating the electrolyte solution and the graphite material.

The second electrode is disposed in the tank and is spaced apart from the agitating unit of the agitating module.

The power supply module is electrically connected to the agitating unit and the second electrode for supplying electric power to the agitating unit and the second electrode to generate an electrical potential difference between the agitating unit and the second electrode.

According to a second aspect of the disclosure, the method includes the steps of: providing the apparatus of the first aspect; disposing an electrolyte solution in the tank and the container; disposing a graphite material into the container; electrolyzing the electrolyte solution to form ions by generating a first electrical potential difference between the agitating unit and the second electrode; intercalating the ions into the graphite material; and agitating the electrolyte solution and the graphite material with the agitating module.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
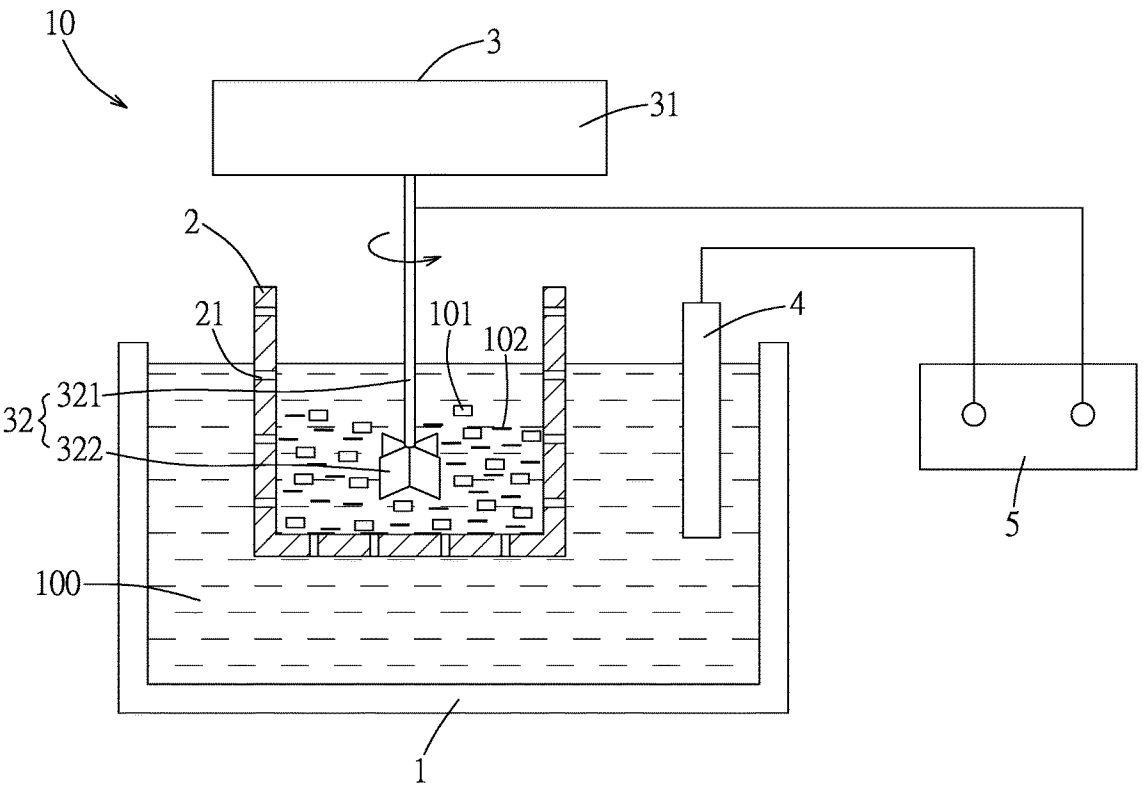
FIG. 1 is a cross-sectional view illustrating an embodiment of an apparatus for producing a graphene material according to the disclosure.

FIG. 1 illustrates an embodiment of an apparatus 10 for producing a graphene material 102 (i.e., graphene layer(s)) according to the present disclosure. The graphene material 102 may be produced from a graphite material 101 (e.g., graphite powder, graphite block, graphite oxide, graphene oxide, etc.) by the apparatus having combined mechanisms of electrochemical exfoliation and mechanical exfoliation. When the graphite material 101 is graphite oxide or graphene oxide, the same is first reduced and then subjected to intercalation and exfoliation.

In the embodiment, the apparatus 10 includes a tank 1, a container 2, an agitating module 3, a second electrode 4, and a power supply module 5.

The tank 1 is used for receiving an electrolyte solution 100 and is made from a material that is resistant to acid, alkali, and organic solvent.

The container 2 is placed in the tank 1, is used for receiving the graphite material 101, and is formed with a plurality of through holes 21 for the electrolyte solution 100 to pass therethrough. Each of the through holes 21 of the container 2 has a maximum diameter not greater than 5 μm, such that the graphite material 101 and the graphene material 102 are limited in the container 2 when the electrolyte solution 100 is flowing through the through holes 21.

The agitating module 3 includes a control unit 31 and an agitating unit 32 that is controlled by the control unit 31. The agitating unit 32 is electrically conductive to be used as a first electrode, and is inserted into the container 2 for agitating the electrolyte solution 100 and the graphite material 101. In this embodiment, the agitating module 3 is a homogenizer. In certain embodiments, the agitating module 3 may be a clarifixator. The agitating unit 32 includes a shank 321 that is connected to the control unit 31, and a plurality of blades 322 that are mounted to the shank 321 and that are disposed opposite to the control unit 31. When the agitating unit 32 is controlled to agitate the electrolyte solution 100, the electrolyte solution 100 generates a shear stress to exfoliate the graphite material 101 to obtain the graphene material 102. The agitating module 3 is not limited to homogenizer and may vary based on actual requirements.

The second electrode 4 is disposed in the tank and is spaced apart from the agitating unit 32 of the agitating module 3. The second electrode 4 may be made of platinum.

The power supply module 5 is electrically connected to the agitating unit 32 and the second electrode 4 for supplying electric power to the agitating unit 32 and the second electrode 4 to generate an electrical potential difference between the agitating unit 32 and the second electrode 4.

Figure 2:
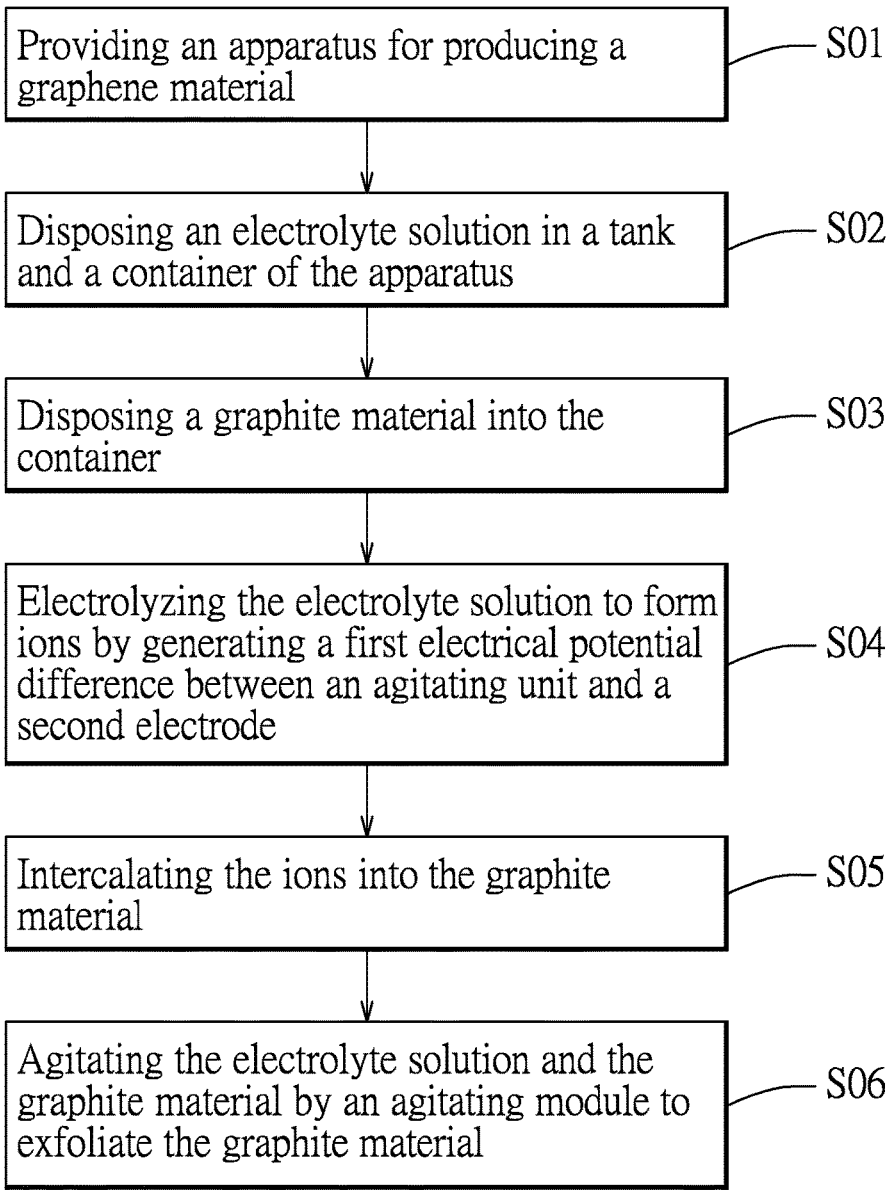
FIG. 2 is a flow chart illustrating a method using the embodiment to produce the graphene material according to the disclosure.

Referring to FIGS. 1 and 2, a method using the embodiment for producing a graphene material includes steps of S01 to S06.

In step S01, the apparatus 10 of the embodiment is provided.

In step S02, an electrolyte solution 100 is disposed in the tank 1 and the container 2. In certain embodiments, the electrolyte solution 100 is a solution containing sulfate ions, e.g., sulfuric acid, copper sulfate solution, etc., and has a pH value ranging from 2.0 to 5.0. The temperature of the electrolyte solution 100 during production of the graphene material 102 ranges from 10° C. to 30° C. A surfactant may be added into the electrolyte solution 100 to improve wettability of the electrolyte solution. The pH value and the temperature of the electrolyte solution 100 may vary based on actual requirements.

In step S03, the graphite material 101 is disposed into the container 2.

In step S04, the electrolyte solution 100 is electrolyzed to form ions (e.g., hydrogen ions) by generating a first electrical potential difference between the agitating unit 32 and the second electrode 4 through the power supply module 5. In this embodiment, the agitating unit 32 has an electrical potential lower than an electrical potential of the second electrode 4, such that the agitating unit 32 serves as a cathode, and hydrogen ions that are generated from the electrolyte solution 100 move toward the agitating unit 32. In this embodiment, the first electrical potential difference is not greater than 10 V, and the electrolyte solution 100 and the graphite material 101 are agitated by the agitating module 3 at a first agitating rate that is not greater than 3000 rounds per minute (RPM). An operating time of the electrolyzing step of this method is not greater than 5 hours, but may vary based on actual requirements.

In step S05, the ions are intercalated into the graphite material 101. In the embodiment, the hydrogen ions are intercalated into the graphite material 101 to expand the graphite material 101.

In step S06, the electrolyte solution 100 and the graphite material 101 are agitated by the agitating module 3 to exfoliate the graphite material 101 to obtain the graphene material 102. A second electrical potential difference may be generated between the agitating unit 32 and the second electrode 4, and the electrolyte solution 100 and the graphite material 101 are agitated by the agitating module 3 at a second agitating rate that is not greater than 20000 rounds per minute (RPM) and that is greater than the first agitating rate. An operating time of the agitating step of this method is not greater than 5 hours. In certain embodiments, the first electrical potential difference may be the same as the second electrical potential difference, and the graphene material 102 may also be intercalated by a gas that is generated through the electrolyzing step.

In this method, reaction yield of the graphene material 102 is improved to be greater than 20%. Furthermore, the graphene material 102 thus produced has an average thickness of around 2.2 nm, an average area ranging from 1 $\mu m^2$ to 1.5 $\mu m^2$, and an average resistivity of around 1.4 Ω-cm.

Alternatively, in certain embodiments, the electrical potential of the agitating unit 32 is higher than that of the second electrode 4, such that the agitating unit 32 serves as an anode, and anions (e.g., sulfate ion) move toward the agitating unit 32 to intercalate into the graphite material 101.

In summary, with the agitating unit 32 as the first electrode and the container 2 formed with the through holes 21, the graphite material 101 received in the container 2 can be intercalated and exfoliated by virtue of the agitation mechanism and the ions generated by electrolysis for effective production of the graphene material 102.

While the disclosure has been described in connection with what is considered the embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An apparatus for producing a graphene material, comprising:

a tank that is adapted for receiving an electrolyte solution;

a container that is placed in said tank, that is adapted for receiving a graphite material, and that is formed with a plurality of through holes for the electrolyte solution to pass therethrough;

an agitating module that includes a control unit and an agitating unit controlled by said control unit, said agitating unit being electrically conductive to be used as a first electrode, and being inserted into said container for agitating the electrolyte solution and the graphite material;

a second electrode that is disposed in said tank and that is spaced apart from said agitating unit of said agitating module; and a power supply module electrically connected to said agitating unit and said second electrode for supplying electric power to said agitating unit and said second electrode to generate an electrical potential difference between said agitating unit and said second electrode.

2. The apparatus as claimed in claim 1, wherein each of said through holes of said container has a maximum diameter not greater than 5 μm.

3. The apparatus as claimed in claim 1, wherein said agitating unit includes a shank that is connected to said control unit, and a plurality of blades mounted to said shank opposite to said control unit.

4. The apparatus as claimed in claim 1, wherein said agitating module is a homogenizer.

5. A method for producing a graphene material, comprising the steps of:

providing an apparatus of claim 1;

disposing an electrolyte solution in the tank and the container;

disposing a graphite material into the container;

electrolyzing the electrolyte solution to form ions by generating a first electrical potential difference between the agitating unit and the second electrode;

intercalating the ions into the graphite material; and agitating the electrolyte solution and the graphite material with the agitating module to exfoliate the graphite material.

6. The method as claimed in claim 5, wherein, in the agitating step, a second electrical potential difference is generated between the agitating unit and the second electrode.

7. The method as claimed in claim 6, wherein, in the agitating step, the agitating unit has an electrical potential higher than an electrical potential of the second electrode.

8. The method as claimed in claim 6, wherein, in the agitating step, the agitating unit has an electrical potential lower than an electrical potential of the second electrode.

9. The method as claimed in claim 5, wherein, in the electrolyzing step, the agitating unit has an electrical potential higher than an electrical potential of the second electrode.

10. The method as claimed in claim 5, wherein, in the electrolyzing step, the agitating unit has an electrical potential lower than an electrical potential of the second electrode.

11. The method as claimed in claim 5, wherein, in the providing step, a surfactant is added into the electrolyte solution.

12. The method as claimed in claim 5, wherein, in the electrolyzing step, the electrolyte solution and the graphite material are agitated by the agitating module at a first agitating rate.

13. The method as claimed in claim 12, wherein, in the agitating step, the electrolyte solution and the graphite material are agitated by the agitating module at a second agitating rate that is greater than the first agitating rate.

* * * * *